US011772112B2

(12) United States Patent
Mittal

(10) Patent No.: US 11,772,112 B2
(45) Date of Patent: Oct. 3, 2023

(54) DOWN-LOCKED PUMP WITH CHAPLET VENT AND BEADED SEAL

(71) Applicant: RIEKE PACKAGING SYSTEMS LIMITED, Leicestershire (GB)

(72) Inventor: Gaurang Mittal, Uttar Pradesh (IN)

(73) Assignee: RIEKE PACKAGING SYSTEMS LIMITED

( * ) Notice: Subject to any disclaimer, the term of this patent is extended or adjusted under 35 U.S.C. 154(b) by 27 days.

(21) Appl. No.: 17/600,619

(22) PCT Filed: Apr. 2, 2020

(86) PCT No.: PCT/EP2020/059451

§ 371 (c)(1),
(2) Date: Oct. 1, 2021

(87) PCT Pub. No.: WO2020/201453

PCT Pub. Date: Oct. 8, 2020

(65) Prior Publication Data

US 2022/0143636 A1 May 12, 2022

(30) Foreign Application Priority Data

Apr. 2, 2019 (IN) ..... 201941013086

(51) Int. Cl.
*B05B 11/00* (2023.01)
*B05B 11/10* (2023.01)

(52) U.S. Cl.
CPC ..... *B05B 11/0044* (2018.08); *B05B 11/106* (2023.01); *B05B 11/1047* (2023.01)

(58) Field of Classification Search
CPC . B05B 11/004; B05B 11/1047; B05B 11/106; B05B 11/1059; B05B 11/00442; B05B 11/0027
See application file for complete search history.

(56) References Cited

U.S. PATENT DOCUMENTS 3,391,647 A * 7/1968 Cooprider ..... B05B 11/306 417/456
4,511,065 A 4/1985 Corsette
5,738,250 A 10/1998 Calmer
(Continued)

FOREIGN PATENT DOCUMENTS

EP 2338607 6/2011
WO 2009050978 A1 4/2009
(Continued)

OTHER PUBLICATIONS

Patent Cooperation Treaty (PCT), International Search Report and Written Opinion for Application PCT/EP2020/059451 filed Apr. 2, 2020, dated Jun. 26, 2020, International Searching Authority, EP.

*Primary Examiner* — Vishal Pancholi
(74) *Attorney, Agent, or Firm* — McDonald Hopkins LLC

(57) ABSTRACT

A dispensing pump capable of withstanding the rigors of "e-commerce" shipping conditions is described. The pump dispenser is integrated with the container's closure. The pump includes a lock-down mechanism to prevent the pump actuator from extending during shipment, while a vented chaplet and an optional beaded seal proximate to the dip tube connection ensure that fluid cannot leak out of the container or the pump.

6 Claims, 7 Drawing Sheets

(56) References Cited

U.S. PATENT DOCUMENTS

| | | | | |
|---|---|---|---|---|
| 6,006,949 | A * | 12/1999 | Foster | B05B 11/0044 222/321.9 |
| 7,802,701 | B2 | 9/2010 | Jahan et al. | |
| 8,827,121 | B2 | 9/2014 | Law et al. | |
| 2015/0238989 | A1 | 8/2015 | Zavarella et al. | |
| 2017/0128966 | A1 | 5/2017 | Law et al. | |
| 2017/0128967 | A1 | 5/2017 | Law et al. | |
| 2018/0304291 | A1 | 10/2018 | Knight | |

FOREIGN PATENT DOCUMENTS

| | | |
|---|---|---|
| WO | 2017186541 | 11/2017 |
| WO | 2017198616 | 11/2017 |
| WO | 2018215658 | 11/2018 |

* cited by examiner

DOWN-LOCKED PUMP WITH CHAPLET VENT AND BEADED SEAL

CROSS-REFERENCE TO RELATED APPLICATION

This application is a 35 U.S.C. § national stage application of PCT Application No. PCT/EP2020/059451 filed on Apr. 2, 2020, which claims priority to Indian Patent Application No. 201941013086 filed on Apr. 2, 2019 each of which are incorporated by reference in their entireties herein.

TECHNICAL FIELD

The present invention relates to fluid dispensers and, more particularly, to a lockable, vented pump with internal sealing that is well suited for ecommerce shipment.

BACKGROUND

Containers for everyday household fluid products, such as soaps, cleaners, oils, consumable liquids, and the like, can be outfitted with dispensing pumps to improve a consumer's ability to access and use the fluid. Dispensing pumps of this type usually rely upon a reciprocating pump, driven by a compressible biasing member.

These products reach the end-use consumer via a bulk-shipment retail supply chain or by way of e-commerce (i.e., delivery to the consumer's home or business). Both supply chains require safeguards against damage and/or leakage of fluid caused by dropping the container(s), vibration, and the like. However, the e-commerce channel is particularly demanding since it is more cost effective to ship individual containers without any additional packaging. Also, because e-commerce shipping does not involve pallets or other means of confining the container to an upright position, the rotation, inversion, and jostling/vibration of the container and dispensing pump increases the likelihood that fluid can leak from the container. Despite these issues, the need for containers with dispensing pumps that can withstand the rigors of shipment also is expected to grow because of the growing popularity of on-line retailers who sell and ship individual fluid-containing products via e-commerce.

In that context, the biasing action of reciprocal pumps is particularly difficult. Most pumps urge the dispensing head upward to create suction that draws up fluid into the chamber to be expelled out of the dispensing head. However, in the extended position, the dispensing head and pump stem are particularly fragile and prone to actuation if the head is depressed. Also, many pumps include air inlets to ensure smooth and efficient dispensing actions, and these inlets themselves present additional pathways for leakage during shipment. Consequently, dispensing pump containers are provided with locking mechanisms in an attempt to avoid leakage and loss of fluid.

One conventional pump mechanism, disclosed in United States Patent Publication 2018/0304291, describes a number of downlock mechanisms which might alleviate some of the concerns noted above. A cylindrical sealing surface is formed on a discrete end piece that is interposed between the pumping piston and the inlet valve/ball valve configuration. This seal engages a corresponding inward nib projection formed near the dip tube socket on the cylinder defining the pump chamber of the piston. In this manner, fluid from the container should not leak into the pump when it is locked down.

However, the inventor has observed that small amounts of fluid do, in fact, enter the pump during simulated e-commerce shipping conditions (e.g., shaking, impact, vibration, etc.). Once the fluid passes the sealing surface, it can escape via the vent holes or, more likely, it will collect in the annular spaces formed within the pumping piston structure. Then, when the pump is unlocked, this fluid will impede proper vent operation and/or leak out along the axial stem.

Other arrangements for pump locks are also known, such as U.S. Pat. Nos. 7,802,701 and 8,827,121; United States Patent Publications 2017/0128966, 2017/0128967, and 2018/0304291; and International Patent Publications WO2018/215658, WO2017/186541, and WO2017/198616. However, the inventor does not believe that these designs adequately address the unique conditions created during e-commerce shipping.

All of the aforementioned patent documents are incorporated by reference. Further, to the extent compatible with the description below, further aspects of the invention may incorporate one or combinations of the features found in these conventional designs.

SUMMARY

The foregoing issues are addressed by way of a pump mechanism that includes a vented chaplet and beaded seal where the pump draws fluid from the container. These features, when used in combination with any manner of down-locking mechanisms provided a pump-enabled container that can be shipped via e-commerce without leakage or loss of fluid.

In one embodiment, the invention may include any combination of the following features:

- a dispensing head having a rotational lock, said dispensing head reciprocating between extended and proximate positions;
- a pump body having a piston and an accumulator defining a pump chamber, said pump body connected to the dispensing head with a biasing member held within the pump chamber and urging the dispensing head into the extend position relative to the pump body;
- a chaplet held between the dispensing head and the pump body, said chaplet having: a hollow cylindrical shape, a vent formed in a sidewall and providing ambient air into the pump chamber when the dispensing head is in the extended position, and a top facing with an engagement mechanism cooperating with the rotational lock;
- wherein: (i) the rotational lock is engaged to selectively hold the dispensing head in the proximate position relative to the pump body, and (ii) when the pump body is in the proximate position, the pump body blocks the vent and prevents ambient air from entering the pump chamber;
- a collar attached the pump body at an end opposite the dispensing head, thereby preventing fluid from entering the pump chamber;
- wherein the collar and the pump body are held together by way of an engagement mechanism comprising a beaded seal;
- wherein the biasing member urges the piston upward within the pump chamber;
- wherein the dispenser head includes a vertical oriented fin which engages at least one ramped protrusion formed on a top facing of the chaplet; and wherein a port is formed at a top end of the accumulator, said port aligning with the vent to admit make-up air into the pump chamber when the rotational lock is not engaged.

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure:

FIG. 3A is an exploded sectional side view of the top or stem portion of the pump of FIG. 1, while

FIG. 4A is a cross sectional perspective view taken along line 4-4 in FIG. 1A with the pump in a closed position, while

FIG. 5A is a cross sectional perspective view taken along a plane that is orthogonal to view illustrated in FIG. 4A but with the pump in an open position (i.e., in the same basic plane as the depiction of FIG. 1B), while

FIG. 8A is a cross sectional perspective view of an alternative arrangement for the ball valve and dip tube juncture, while

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggests otherwise.

Any descriptions and drawings in this disclosure, and any written matter within the drawings, should be deemed to be reproduced as part of this specification.

Figure 1A:
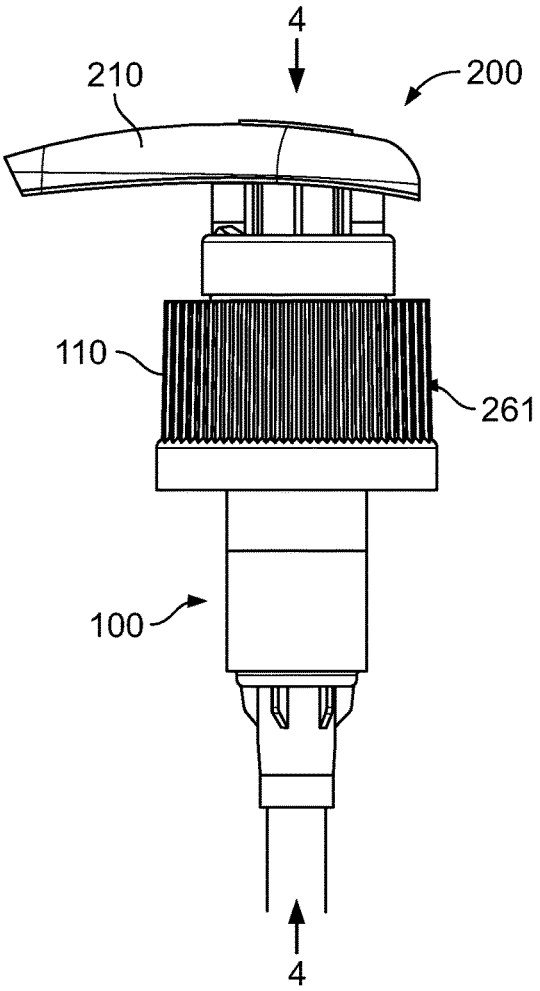
FIGS. 1A and 1B are side plan views of the pump mechanism according to certain embodiments showing the change in elevation of the dispenser/actuating head in the closed (FIG. 1A) and open (FIG. 1B) positions.
Figure 1B:
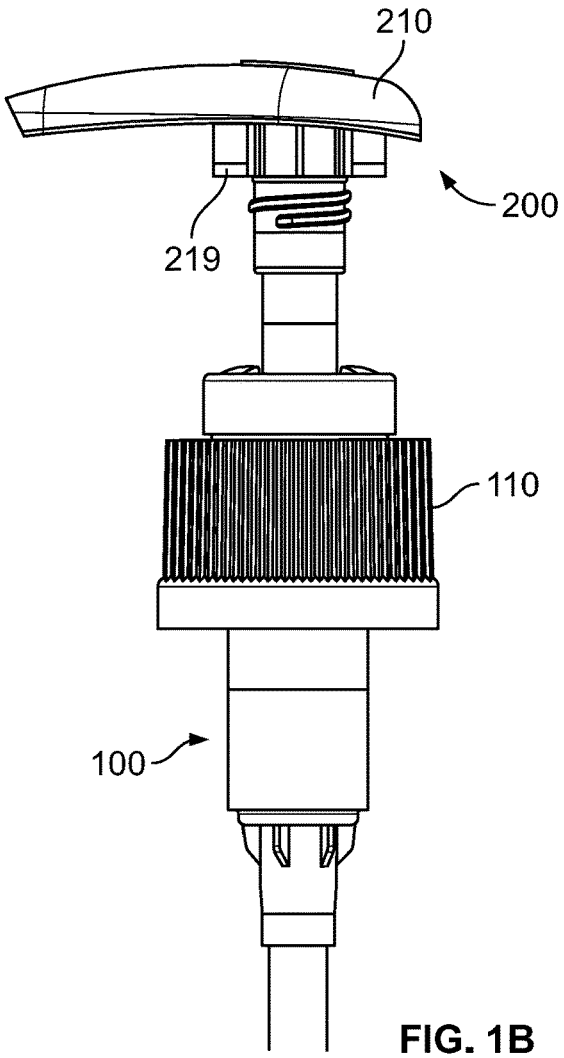

As seen in FIGS. 1A and 1B, a reciprocating pump 100 is integrated within a closure 110 for a container (not shown). Insofar as the pump 100 is designed to prevent leakage under e-commerce shipping conditions, it will be understood that the container must be able to also withstand such conditions. Nevertheless, so long as the closure 110 cooperates with and attaches to the opening of the container, virtually any type of container could be used. Most commonly, the container will comprise a hollow tube that is sealed along its bottom end, while the container opening will include threads, snap fittings, or other common attached mechanisms to allow the closure 110 to be coupled thereto.

Pump 100 includes several distinct portions. As noted above, the closure 110 for connecting and sealing the container. The dispensing end 200 incorporates a dispensing outlet 212. In broad terms, it includes a piston 230 in an accumulator 240 connected to an intake portion 300, while a biasing member 250 urges the dispensing end 200 into its extended or open position, as shown in FIG. 1B.

Figure 2:
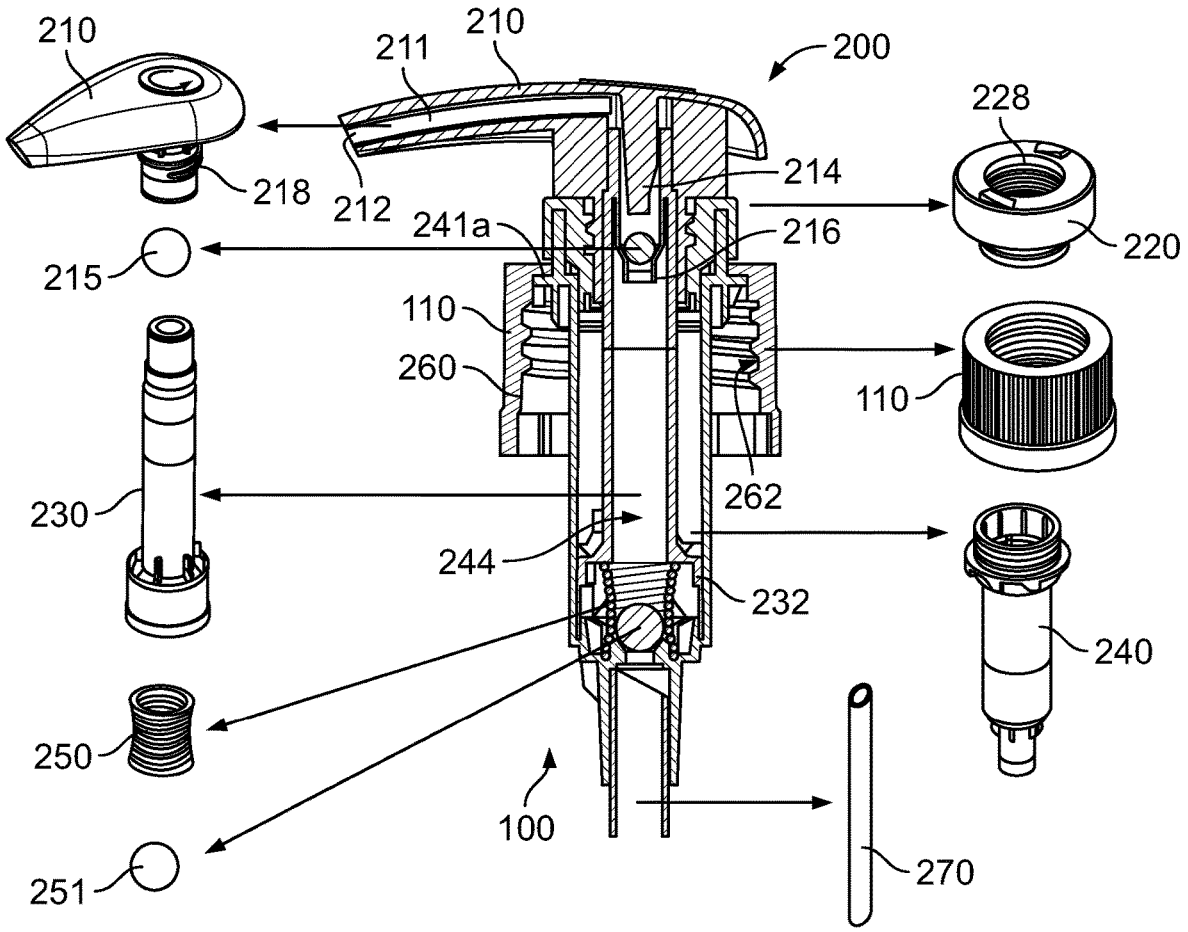
FIG. 2 is a cross sectional side view of the pump of FIG. 1, including exploded sectional perspective views of the individual components comprising that pump.
Figure 3A:
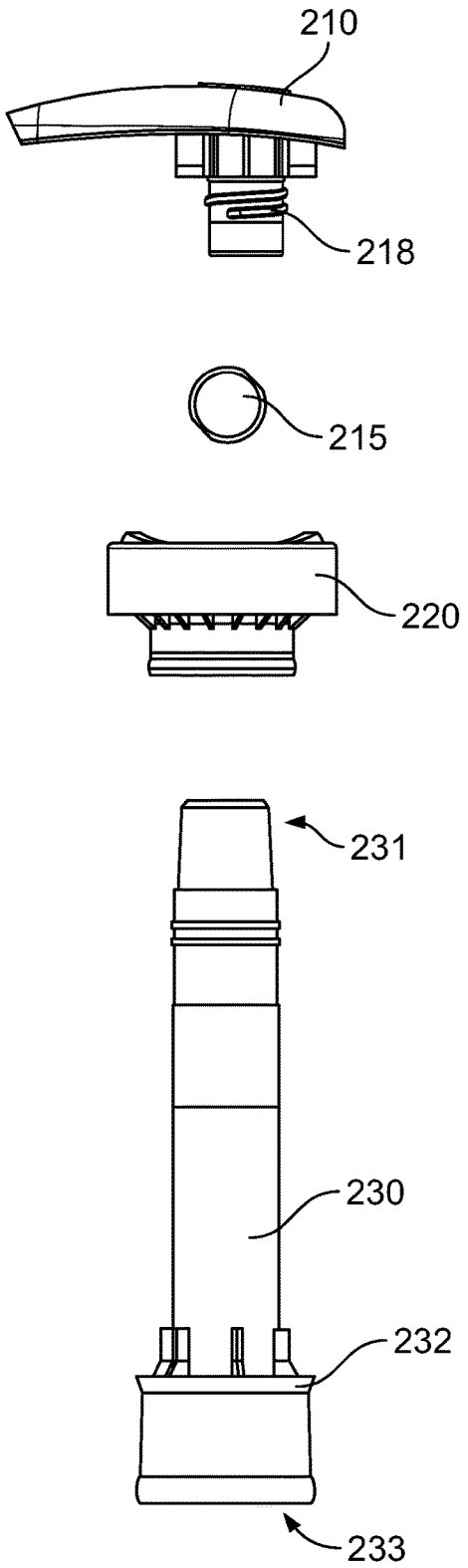
Figure 3B:
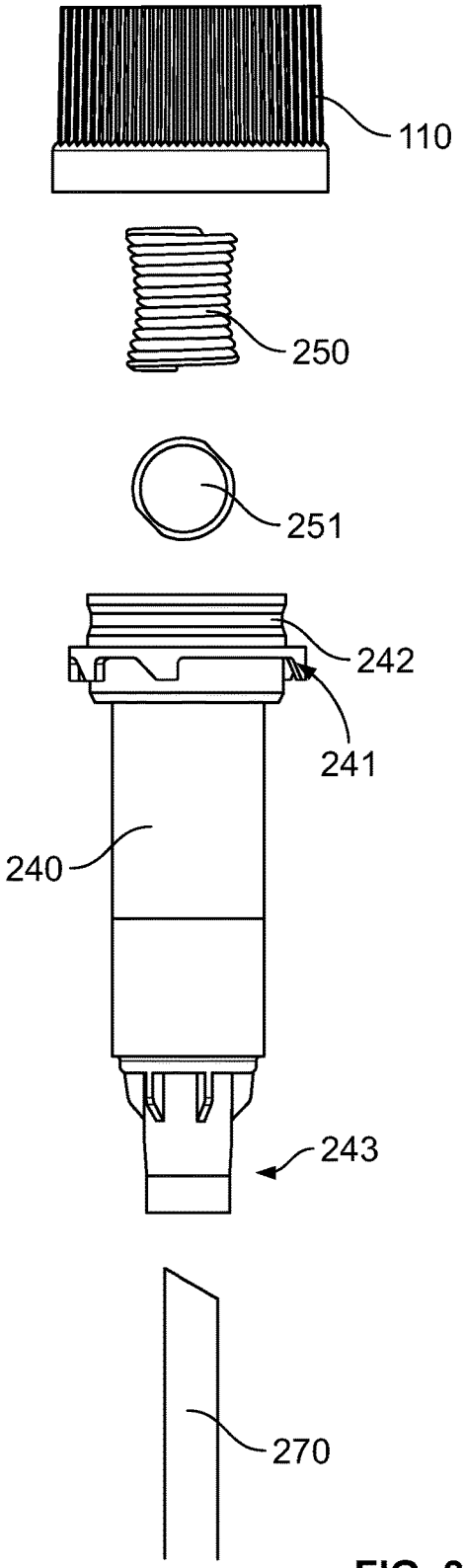
FIG. 3B is an exploded sectional side view of the bottom or accumulator portion of that pump.
Figure 4A:
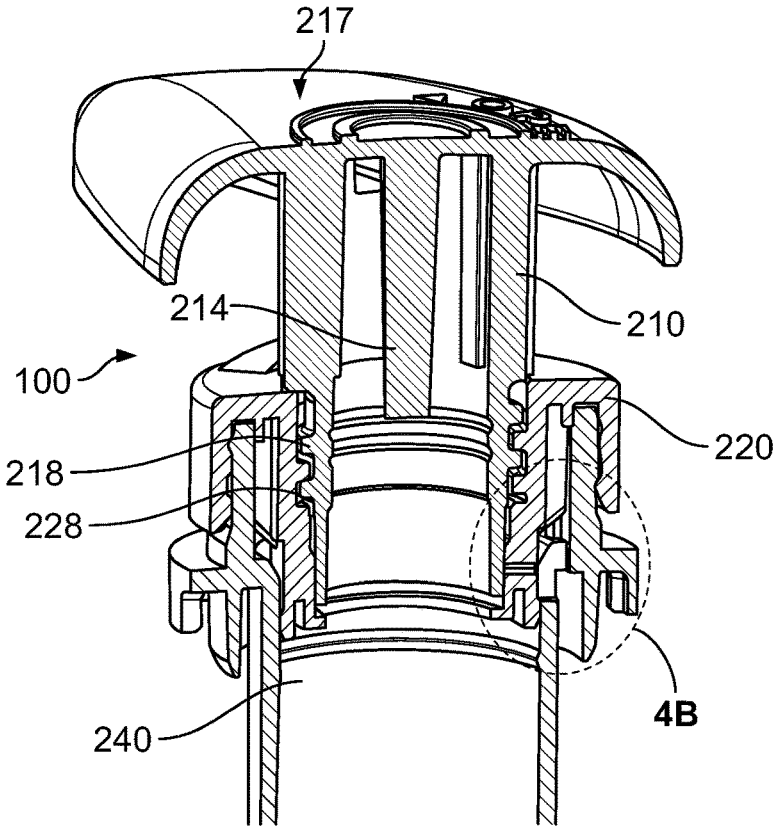
Figure 4B:
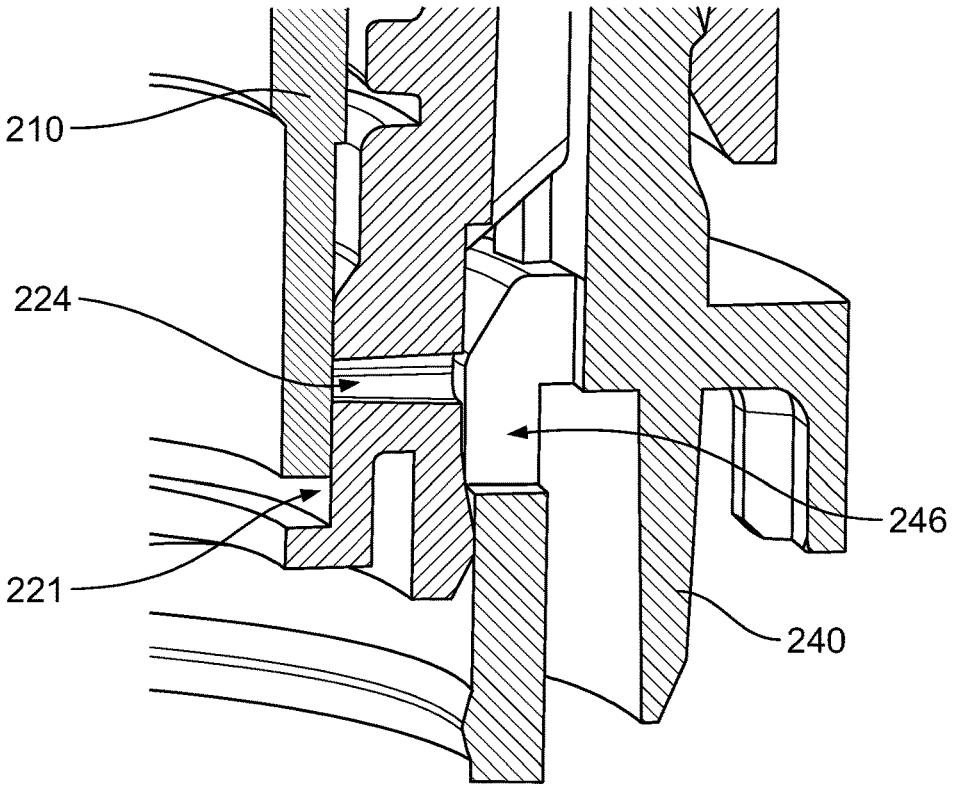
FIG. 4B is an exploded sectional view of callout 4*a* in FIG. 4A.
Figure 5A:
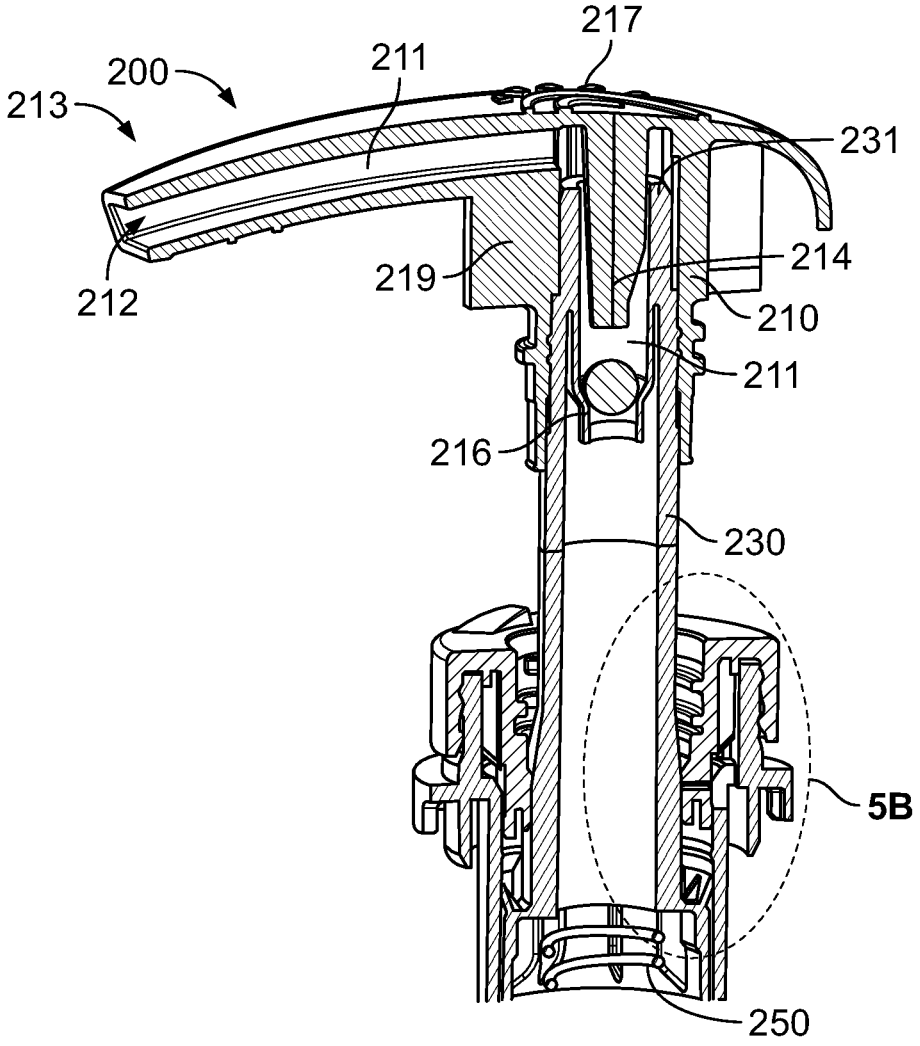
Figure 5B:
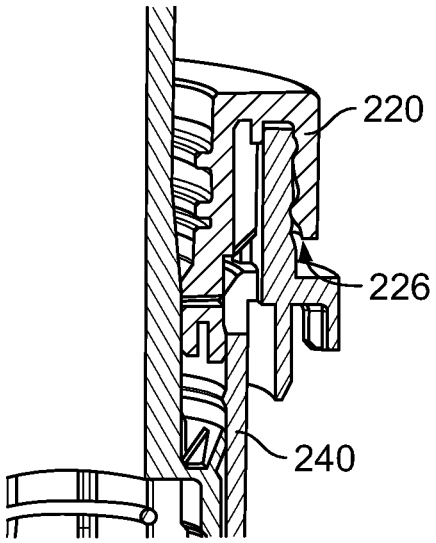
FIG. 5B is an exploded sectional view of callout 5*b* in FIG. 5A.
Figure 6:
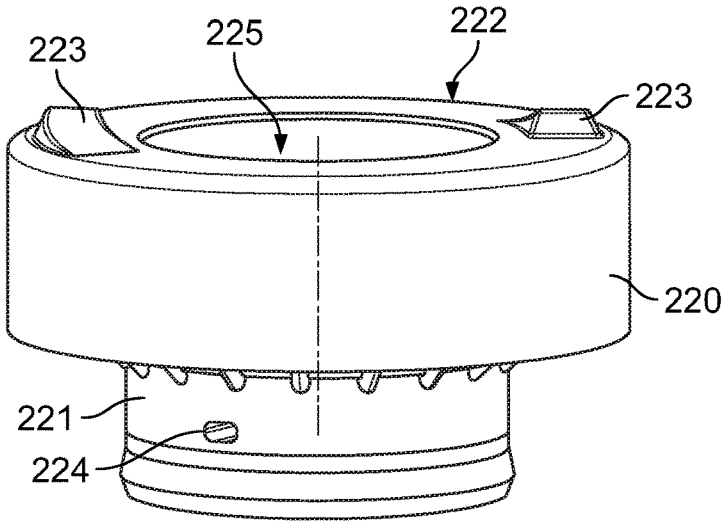
FIG. 6 is a sectional perspective view of the vented chaplet according to certain embodiments.
Figure 7:
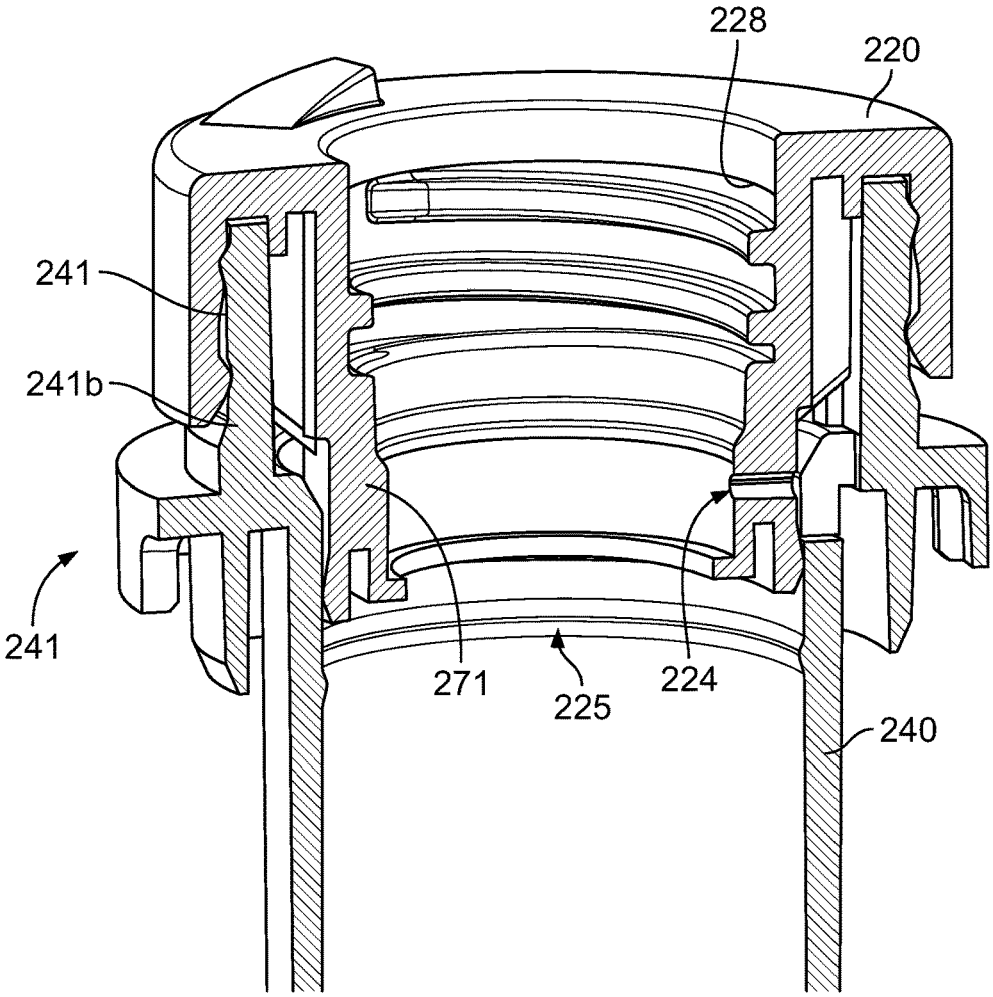
FIG. 7 is a cross sectional perspective view of the chaplet of FIG. 6 fitted onto an accumulator for use in a pump, such as the accumulator and pump shown in FIGS. 1 and 2 above.

These portions—and their corresponding components—are further defined and described in FIGS. 2, 3A and 3B. First, dispensing end 200 includes a head 210. The interior of head 210 defines a hollow dispensing channel 211 with outlet aperture 212 disposed at the distal end 213 of head 210. The channel 211 is angled to redirect fluid flowing up from the container (via the piston 300) toward the outlet 212. A coaxial stopper 214 is positioned within the channel to restrain the upward movement of piston check valve/ball 215. Piston ball 215 is rests in a sealed position within a cage 216 that is also integrated within the channel 211.

The redirection of the fluid by way of head 210 lends an L- or J-shape to the head 210. Its exterior top 217 presents a flat and/or smooth portion that effectively allows a user to press down on the head 210 easily. Engagement formations 218 may be formed on the head to attach to an annular chaplet 220 that fits beneath the base of head 210 around the piston 230.

Chaplet 220 is a hollow cylinder, with corresponding engagement formations 228 on its interior side walls 221. Formations 228 cooperate with those 218 on the head 210 to secure the pieces together. A top facing 222 incorporates ramped stoppers 223 to engage a vertically oriented rib or fin 219 to facilitate the rotational lockdown functionality described herein.

Significantly, chaplet 220 includes a vent through-hole 224 in its sidewall 221. As will be described in greater detail below, vent 224 is sealed when the pump 100 is in its lock-down position, thereby confining fluid in the container without unwanted loss or leakage, even when container is exposed to jostling, vibration, impact, and other e-commerce shipping-type conditions.

Piston 230 is received within head 210. The two form a fluid seal in order to define a portion of the channel 211 along their interior and proximate to the check valve 215. In some embodiments, ball 215 and cage 216 can be formed as part of the piston 230, as part of the head 210, or as a combination of the two. Top end 231 of piston is snap fitted, adhered, or coupled to the head 210.

Piston 230 also passes through the inner aperture 225 of chaplet 220. In an alternative embodiment, it may be possible to form engagement formations (not shown) on the surface of piston 230 so that it attaches to the chaplet 220. As shown herein, a wedge portion of head 210 is interposed between the piston 230 and chaplet 220 at the junction/sealing surface of piston 230 and head 210.

Piston 230 is also a hollow tube so as to define the fluid channel 211 running through the pump 100. On its outer surface, piston 230 is coaxially received within a hollow, tubular accumulator 240. In this arrangement, piston 230 axially moves within the accumulator 240 to allow dispensing end 200 to move away from the container (again, as comparatively illustrated in FIGS. 1A and 1B). Notably, this range of movement also allows for the reciprocating motion that creates sufficient suction for pump 100 to move fluid from container out through the dispensing outlet 212.

Annular flange 232 creates an increased diameter at the lower end 233 of piston 230. In this manner, flange 232 catches the underside of the chaplet 220 to prevent the piston 230 from becoming detached from the head 210 and/or accumulator 240. A sealing skirt 234 is positioned proximate to the flange 232 to seal the interior of the accumulator 240 when the piston 230 is extended upward. In this manner, fluid remains within the channel 211 at all times.

At lower end 233, piston 230 receives spring 250 and accumulator valve ball 251 along its interior. Ball 251 may be temporarily displaced upward, in the axial direction, to allow fluid to enter the channel 211 when suction is created within the piston 230 by the reciprocating movement of the piston 230. Ball 251 seals the channel 211 by sitting in a conical seat 252 formed at the top interior end of the hollow-tubularly shaped accumulator 240. Spring 250 may have an hourglass shape so as to receive the ball along its lower interior. The upward movement of the ball during priming of the pump 100 may also be restrained by spring 250 (and/or other structural features of the piston 230 and/or accumulator 240).

The accumulator 240 is a hollow tubular structure fitting coaxially around the lower end 233 of piston 230. A radially/circumferentially flanged top end 241 includes engagement structure 242 to attach the accumulator 240 to the dispensing end 200 (e.g., by way of an airtight seal at the chaplet 220). It may also be possible for structure on the top end 241 to extend inwardly to seal to the chaplet 220 and/or piston 233. Notably, the internal volume of the hollowed accumulator 240 between the top end 241 and the bottom end 243 defines the pump chamber 244, as well as the range of motion through which the piston 230 may move. As such, ledges, stoppers, or other structure within a facing of the pump chamber 244 (either on the accumulator 240 or the chaplet 220) confine the range of motion of the piston 230.

A threaded annular skirt 260 may be held between a circumferential ledge 241*a* and the bottom peripheral edge of the chaplet 220. Top engagement cylinder 241*b* is received within an axial gap or groove 226 formed on the underside (i.e., facing the container) of chaplet 220. Engagement mechanism between these, and any other parts disclosed herein, can be by snap-fitting grooves (intermittent or annular) and protrusions (intermittent or annular), cooperating threaded or screw fittings, interference fit, or other similar known means.

The skirt 260 includes an outer facing 261 that may be knurled, grooved, or otherwise textured for improved grip and/or aesthetics. A gap is formed between the skirt inner facing 262 and the top end 241 into which the container neck may engage the pump 100. In some views, skirt 260 has been omitted to provide a clearer view. It may be possible to integrate some or all of the structures for the skirt 260 into the top end 241 of the accumulator 240.

As noted above, piston 230 slides axially within the accumulator 240, with lower end 233 sealingly engaging the inner surface of the accumulator to create suction as the head 210 is pushed upward by spring 250 (when the pump 100 is not locked down). This suction urges ball 215 against an abutment 214 fitted to top 217 within channel 211. In the same manner, ball 251 is displaced to admit fluid from the container into the pump body/channel 211. Suction ceases at the top end of the range of motion, allowing gravity to drop valve 251 back into a closed position. Then, upon depressing/actuating head 217, the pump body/channel is compressed axially downward, causing the fluid in the chamber to temporarily displace ball 215 and force the fluid through the head 210 and outlet 212.

At its lower end 243, accumulator 240 attaches to a dip tube 270. As such, dip tube 270 is a hollow, straw-like structure engaged with the accumulator, preferably by way of an interference fit. Tube 270 effectively forms an extension of channel 211 and serves as an inlet to the pump chamber 244, which ball 251 selectively sealing the chamber 244 depending upon actuation state of the pump 100.

Figure 8A:
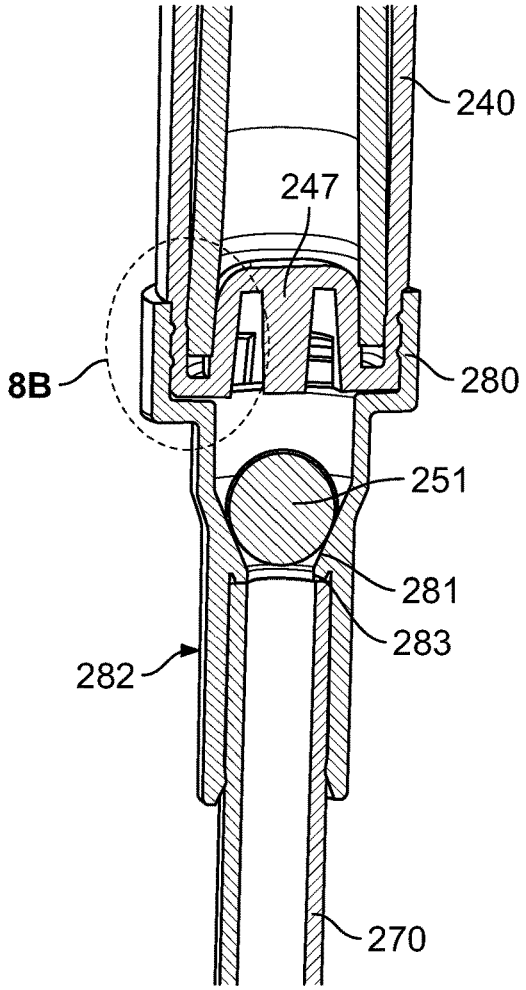
Figure 8B:
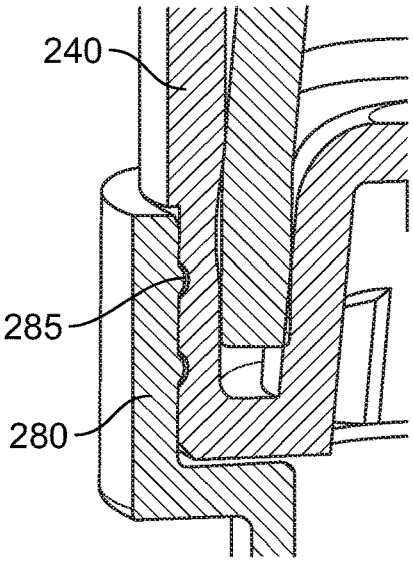
FIG. 8B is an exploded sectional view of callout 8*b* in FIG. 8A.

As seen in FIGS. 8A and 8B, an alternative means of connecting the lower end 243 to the piston 230 and the dip tube 270 is illustrated. Here, collar extension 280 attaches by way of a bead and groove arrangement to the outer circumference of the lower end 243. Ball valve 251 is held within an inner funnel shape 281 of the collar 280 so as to seal the lower end of the pump chamber 244. A slotted cage formation 245 is formed on the accumulator 240 along its inner/cportentral axis to restrain upward movement of the ball 251. A receiving port 282 attaches to the dip tube 270, with an inner annulus 283 acting as a stop for the tube 270.

At the top end 284 of the collar 280, engagement features 285 attach the collar 280 to the accumulator 240. In a preferred embodiment, features 285 comprise one or more annular beads fitted within cooperating grooves on the opposing piece. Integral cage or retaining structure 247 is formed with the accumulator 240 (as shown) or as part of the collar 280. In either instance, cage 247 defines the upper end of motion for the ball 251. All of these features cooperate to form an improved seal at the lower extremity of pump 100, thereby retaining and restraining fluid within the container during e-commerce shipping.

One of the key features of the pump 100 is its down-lock functionality. While a number of down lock mechanisms are noted above (and may be incorporated as substitutes), one embodiment contemplates a rotational lock holding the head 210 in down-locked position. This function is accomplished by providing cooperating screw threads on the lower outer surface of the head 210 and the inner wall of the chaplet 220. Stoppers 223 engage similar structure on a flat/horizontal facing of the bottom of the head 210 to prevent overtightening and to ensure alignment of the chaplet vent 224 and a corresponding port or gap 246 provided at the top end 241 of the accumulator.

When screwed together/engaged, head 210 and chaplet 220 compress the spring 250 and prevent actuation or priming of the pump. Further, in this arrangement, the vent 224 and port 246 are offset so as to block and seal both. However, when the lock is disengaged, vent 224 and port 246 are aligned so as to allow communication of air/fluid from the interior of the container to the ambient environment (i.e., to allow for make-up air to be admitted).

The relative, circumferential positioning of the stoppers 223 relative to the vent 224, as well as the rotational length of the threads, is key. These features must be designed to ensure that, upon lockdown, the vent 224 and port 246 are not aligned.

It may be possible to provide a plurality of vents 224 and/or port 246. Further, stopper 223 need not completely prevent rotation and, instead, could simply provide tactile feedback for the user to know when the lock is engaged or disengaged.

Further aspects of the invention may be discerned from careful study of the features illustrated in the drawings. While structures that are most pertinent to the operation of the pump 100 are highlighted above, still further functions and structures will be appreciated by skilled persons upon studying the drawings in their entirety, particularly with respect to beads, flanges, screw threads, grooves, and cooperating/fitted components.

In view of the foregoing, various aspects of the invention can include any combination of the following features:

- a dispensing head reciprocating between extended and proximate positions;
- a pump body having an accumulator defining a pump chamber, piston received within the accumulator and attached to the dispensing head, and a biasing member held within the pump chamber and urging the piston into the extended position relative to the pump body;
- a rotational lock temporarily restraining the dispensing head in the proximate position relative to the pump body when the rotational lock is engaged;
- a chaplet held between the dispensing head and the pump body, said chaplet having: a hollow cylindrical shape, a vent formed in a sidewall and providing ambient air into the pump chamber when the dispensing head is in the extended position, and a top facing with an engagement mechanism cooperating with the rotational lock;
- wherein, when the pump body is in the proximate position, the pump body seals the vent and prevents ambient air from entering the pump chamber;
- a collar extension attached the accumulator and preventing fluid from entering the pump chamber except when the dispensing head is actuated by reciprocation;
- wherein the collar extension and accumulator are connected by a beaded seal;
- wherein a ball valve is held within the collar extension;
- wherein the rotational lock comprises a vertical oriented fin on the dispenser head which engages at least one ramped protrusion formed on a top facing of the chaplet;
- wherein a port is formed at a top end of the accumulator, said port aligning with the vent to admit make-up air into the pump chamber when the rotational lock is not engaged; and
- wherein the biasing member urges the piston upward within the pump chamber.

All components should be made of materials having sufficient flexibility and structural integrity, as well as a chemically inert nature. The materials should also be selected for workability, cost, and weight. In addition to the materials specifically noted above, common polymers amenable to injection molding, extrusion, or other common forming processes should have particular utility, although metals, alloys, and other composites may be used in place of or in addition to more conventional container and closure materials.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

The invention claimed is:

1. A pump comprising:

- a dispensing head reciprocable between extended and proximate positions;
- a pump body having an accumulator defining a pump chamber, a piston received within the accumulator and attached to the dispensing head, and a biasing member held within the pump chamber and urging the piston to the extended position relative to the pump body;
- a rotational lock to temporarily restrain the dispensing head in the proximate position relative to the pump body when the rotational lock is engaged;
- a chaplet held between the dispensing head and the pump body, said chaplet having:
  - a hollow cylindrical shape,
  - a vent formed in a sidewall to provide ambient air into the pump chamber when the dispensing head is in the extended position, and
  - a top facing with an engagement mechanism cooperating with the rotational lock;
- wherein the accumulator includes a lower end having an integral cage defining an upper limit for a ball valve and collar extension sealingly couples to an outer surface of the lower end, said collar extension having an inner funnel shape to receive the ball valve;
- wherein a port is formed in a sidewall near a top end of the accumulator, aligning with the vent to admit make-up air into the pump chamber when: i) the dispensing head is in the extended position and ii) the rotational lock is not engaged; and
- wherein, when in the proximate position, the pump body seals the vent and prevents ambient air from entering the pump chamber.

2. The pump according to claim 1 wherein the collar extension and accumulator are connected by a beaded seal.

3. The pump according to claim 1 wherein the rotational lock comprises a vertical oriented fin on the dispenser head which engages at least one ramped protrusion formed on a top facing of the chaplet.

4. The pump according to claim 3 wherein a port is formed at a top end of the accumulator, said port aligning with the vent to admit make-up air into the pump chamber when the rotational lock is not engaged.

5. The pump according to claim 4 wherein the biasing member urges the piston upward within the pump chamber.

6. The pump according to claim 1 wherein the biasing member urges the piston upward within the pump chamber.

* * * * *